US006057807A

United States Patent [19]

Marthinsson et al.

[11] Patent Number: 6,057,807

[45] Date of Patent: May 2, 2000

[54] DUAL BAND ANTENNA MEANS INCORPORATING HELICAL AND ELONGATED RADIATING STRUCTURES

[75] Inventors: Magnus Marthinsson, Åkersberga; Gunnar Filipsson, Linköping, both of Sweden

[73] Assignee: Allgon AB, Åkersberga, Sweden

[21] Appl. No.: 08/966,852

[22] Filed: Nov. 10, 1997

Related U.S. Application Data

[63] Continuation of application No. PCT/SE97/00229, Feb. 13, 1997.

[30] Foreign Application Priority Data

Feb. 13, 1996 [SE] Sweden ..... 9600538

[51] Int. Cl.[7] ..... H01Q 1/36; H01Q 1/24

[52] U.S. Cl. ..... 343/895; 343/702

[58] Field of Search ..... 343/895, 702, 343/900, 901, 725, 727, 853; H01Q 1/36, 1/24

[56] References Cited

U.S. PATENT DOCUMENTS

| | | | |
|---|---|---|---|
| 4,442,438 | 4/1984 | Siwiak et al. | 343/792 |
| 4,868,576 | 9/1989 | Johnson, Jr. | 343/702 |
| 5,469,177 | 11/1995 | Rush et al. | 343/702 |
| 5,583,520 | 12/1996 | Thill | 343/702 |
| 5,650,789 | 7/1997 | Elliott et al. | 343/702 |
| 5,734,351 | 3/1998 | Ojantakanen et al. | 343/702 |
| 5,764,191 | 6/1998 | Tsuda | 343/702 |
| 5,945,964 | 8/1999 | DeGroot et al. | 343/895 |

FOREIGN PATENT DOCUMENTS

| | | |
|---|---|---|
| 0 367 609 | 5/1990 | European Pat. Off. . |
| 0 467 822 | 1/1992 | European Pat. Off. . |
| 0 634 806 | 1/1995 | European Pat. Off. . |
| WO94/10720 | 5/1994 | WIPO . |
| WO94/28593 | 12/1994 | WIPO . |
| WO95/12224 | 5/1995 | WIPO . |
| WO97/18601 | 5/1997 | WIPO . |

*Primary Examiner*—Don Wong
*Assistant Examiner*—Shih-Chao Chen
*Attorney, Agent, or Firm*—Jacobson, Price, Holman & Stern, PLLC

[57] ABSTRACT

A multi-band antenna for mounting on the housing of a hand-portable telephone, the antenna comprising a feed portion and an antenna whip, arranged to slide into and out of the telephone to retracted and extended positions and combined with a multi-band helical structure. There are alternative ways disclosed of arranging the helical structure and other possible radiating elements of the antenna means to attain operability within separated frequency bands, for example, at 900 and 1800 MHz. In some configuration, the antenna means requires an impedance matching circuit in order to be operable at different frequency bands.

25 Claims, 4 Drawing Sheets

DUAL BAND ANTENNA MEANS INCORPORATING HELICAL AND ELONGATED RADIATING STRUCTURES

This application is a continuation of the international application PCT/SE97/00229, filed Feb. 13, 1997.

FIELD AND BACKGROUND OF THE INVENTION

The invention relates to an antenna means having a helical radiating structure in combination with an extendable radiating structure. Specifically, it relates to a dual band antenna device for a mobile radio communication device, e.g., a hand-portable telephone, which is capable of both transmitting and receiving on two separate frequency bands. This would increase the probability of the telephone being operable for communication in a site where service is available within more than one band. Such a telephone may be a terminal in, e.g., a GSM, PCN, DECT, AMPS, PCS, and/or JDC cellular telephone system, possibly having an additional pager function or other radio facilities. In the specification and claims the words "dual band" should, as a general rule, be understood as "operating within at least two frequency bands". Also, when referring to two frequency bands or similar, it could include generally at least two frequency bands. The frequencies included in the dual or multiple bands of the invention do not need to have any fixed relationship to one another and may thus have arbitrary separations.

PRIOR ART

In the past antenna means including a helical element in combination with an extendable whip antenna have been used for hand-portable cellular telephones in order to achieve compact dimensions and durability while maintaining high efficiency in call mode. One feature of a resonant antenna in general is that it is operable within one fundamental frequency band and within higher frequency bands, but only those having a fixed and predetermined relation to the fundamental frequency band. The ranges of higher frequency bands depend on, inter alia, antenna geometry. An inherent, higher frequency band may not appear where desired for a given geometry of a radiator. A problem related to small-size helical antennas in general is their narrow bandwidth. Problems will arise in a dual band device when combining antennas, which have different geometries and resonance frequencies, with regard to operable frequency bands and impedance matching to circuitry of the radio communication device.

In a radio device, such as a personal telephone, it is advantageous to achieve an antenna means that has an effective radiation distribution and a high degree of efficiency. The telephone may preferably function in different operating modes. Two different operating modes are a stand-by mode and a call (talk) mode. In these two operating modes there are different demands upon the antenna means. For example, if the telephone is carried in the stand-by mode, the carrier (a person) may require a small-size and compact configuration of the telephone. An antenna means extending too far from the telephone may be inconvenient in this case.

The reception and transmission performance of an antenna means depends not only on the antenna means itself, but also on a radiation path between the telephone and a base station. Obstacles in the radiation path will lower the communication performance of the antenna. In personal telephones it is important that the body of the user does not excessively obstruct the radiation path. Therefore, an antenna means extending sufficiently far from the housing of the telephone is desirable in the call mode when demands for performance are higher. Also, antennas extending at least about a quarter wavelength from the telephone tend to be generally more efficient.

A specific type of antenna means, which has been used on personal telephones to provide satisfactory performance, is disclosed in, e.g., U.S. Pat. No. 4,868,576 (Motorola), WO 94/10720 (Allgon), and WO 94/28593 (Allgon). This type of antenna means use one helical antenna mounted on a housing of a telephone. Axially through the helical antenna there is provided a slidable elongated radiator (which may be formed as a thin and compact coil to improve flexibility) which is extended to increase antenna performance and retracted to increase compactness of the telephone, respectively, as required. WO 95/12224 (Allgon) includes the same basic type of antenna and suggests means for broadening the bandwidth of a helical structure to be operable in, e.g., the Japanese cellular telephone system, JDC. The helical structure disclosed in that document can even be expected to expand the total bandwidth in excess of the sum of the bandwidth of each respective coil alone, see FIG. 5.

Another type of antenna means, disclosed in EP-A2 0 467 822 (Galtronics), comprises a slidable antenna whip which contains a straight radiator in its bottom portion and a helical radiator in its top portion. In spite mechanical differences the radiating functions of that antenna means in retracted and extended positions are similar to the above-described type. These disclosed antenna means are only capable of operating within one frequency band and they cannot be modified within the disclosed configurations to operate within two separated frequency bands. The pending Swedish patent application no. 9504071-3, which is a priority application of WO 97/18601 published May 22, 1997, relates to a dual band antenna means comprising two or more helices and that document is incorporated herein by reference.

SUMMARY OF THE INVENTION

A main object of the invention is to provide a dual band antenna means of the above-mentioned types combining helical and elongated radiators for different operating modes, the inventive antenna means being capable of transmitting and receiving RF signals in each one of two frequency bands. Specifically the antenna means is intended as a single, sufficient antenna means to fulfill the requirements under normal operating conditions of a portable radio device capable of both transmitting and receiving in two frequency bands. A particular object of the invention is to provide a dual band antenna means which exhibits high efficiency in the different operating modes, radiation lobe pattern without significant "dead angles", and sufficient wide band characteristics in each of its operable bands. The antenna means preferably includes an efficient impedance matching means. It may further provide a connection to an external antenna.

Moreover, the antenna means of the invention should enable a suitable interface to the radio device, so that no switching means is required in order to operate within more than one frequency band.

Yet another object of the invention is to provide a dual band antenna means compact and durable enough for portable radio equipment. Still another object of the invention is to provide a dual band antenna means which is suited for manufacturing cost-effectively in large quantities.

These objects are attained by a dual band antenna means according to the appended claims.

In a configuration with the elongated radiator structure in an extended position, a high-efficient configuration of the antenna means and operability within separated frequency bands are attained in a second operating mode.

In arranging helical coils coaxially and preferably coextending together with a retracted elongated radiator structure, a compact configuration of the antenna means and operability within separated frequency bands are attained in a first operating mode. According to simulation and test results it has been confirmed that an antenna means consisting of two helical coils, tuned to frequencies within two respective non-overlapping frequency bands and arranged concentrically, one inside the other with a small separation will fulfill the electrical demands for efficiency, lobe pattern, and bandwidth, in spite the fact that they couple capacitively and inductively to each other. However, in the helical structure of the invention, the attainable (relative) bandwidth in each of the separated frequency bands may even be smaller than a bandwidth of a separate coil alone. In many modern cellular telephone systems, these narrow bands will still be acceptable, in particular in a stand-by operating mode.

If a wire material of the helical coils is sufficiently thin, the helical structure does not require any essential enlargement of a housing compared to that which receives a movable antenna whip and encloses a single helical radiating element of an antenna means tuned to the lower frequency band only. In fact, some preferred embodiments arrangements having a relatively high inner coil which serves an upper band including frequencies approximately twice as high as those of the lower band. A higher inner coil tends to give a better lobe pattern for its frequency band.

Further test results have shown that it is advantageous to arrange two coils, one inside the other, having different pitches (preferably greater pitch of inner coil) and approximately the same axial lengths. The best bandwidth performance has been obtained for a relative rotation of the coils where their upper free ends oppose each other at an angle of about 180° about a common axis.

The term feeding portion used in the description and claims should be interpreted as a conductive body at which a radiating structure is fed with RF energy. It may be a part of a wire of a coil or an elongated radiator, a part of the radio communication device, and/or a body arranged between the radiating structure and the radio communication device.

DESCRIPTION OF PREFERRED EMBODIMENTS

Figure 1:
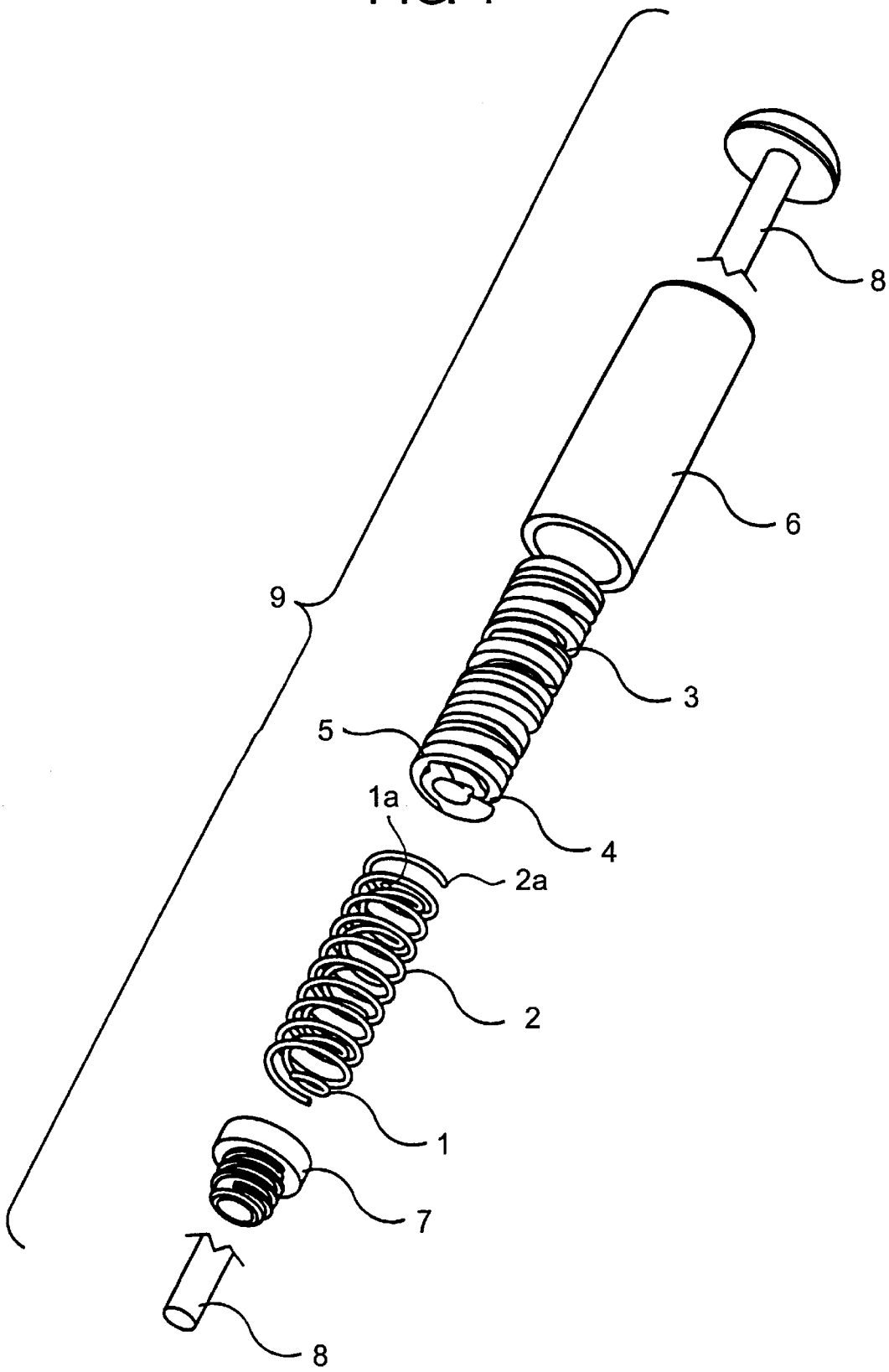
FIG. 1 shows an exploded view of a first part of an antenna means according to preferred embodiments of the invention including helical elements, an antenna whip a lower portion of which includes a straight radiator, a carrier, a fitting, and a protective housing.

With reference to FIG. 1, the embodiments of a dual band radiating means 9 according to the invention includes an assembly of first and second helical radiating elements 1, 2 to be mounted in helical grooves 3, 4 of a dielectric carrier 5, the latter being provided with a cylindrical opening extending longitudinally through the center thereof, a dielectric protective sleeve 6 to receive the helices 1, 2 and the carrier 5, and a conductive fitting 7, to which the helices 1, 2 are connected and the carrier 5 and sleeve are fixed mechanically, the fitting 7 being provided with an opening forming an extension of the opening of the carrier 3 when fixed thereto. The two helices 1, 2 have approximately the same total axial lengths, the inner coil 1 having a smaller diameter and a greater pitch than the outer coil 2. This enables the structure to resonate at different frequencies in widely separated frequency bands, e.g., at first and second frequency bands around 1800 and 900 MHz, respectively. A first center frequency of said first frequency band and a second center frequency of said second frequency band may thus have the ratio of approximately 1:2.

In order to optimize the bandwidth, the free ends 1*a*, 2*a* of the coils 1, 2 are preferably arranged to approximately oppose each other diametrically in relation to their common axis. Hence, the invention includes a way to vary the rotational relation of the free ends of the coils for obtaining a desired, optimal performance.

The said assembly is screwed via the fitting 7 onto a housing of a portable telephone (not shown). The conductive fitting 7 acts as a feed portion for the helices 1, 2 and couples them to transmitter and receiver circuits (not shown) inside the telephone.

The dual band radiating means further includes an antenna whip 8 which is slidable into and out of the telephone longitudinally through the said assembly to extended and retracted positions (not shown). The antenna whip 8 includes a straight radiator in a lower portion thereof. An upper portion thereof is non-conductive and provided with a knob. The straight radiator, if exited independently, is resonant in a first mode within one of the first and second bands only.

In the retracted position, the straight radiator of the whip is located preferably completely inside the telephone. In this first configuration, the helices alone provide an antenna function of the telephone.

In the extended position, a lower end portion of the straight radiator makes contact with the conductive fitting 7. Then, the straight radiator is connected in parallel with the helices 1, 2 via the fitting 7 to the tranciever circuits. In this second configuration, due to an impedance relation between the radiators, it is mainly the straight radiator that provides the antenna function of the telephone.

Figure 2A:
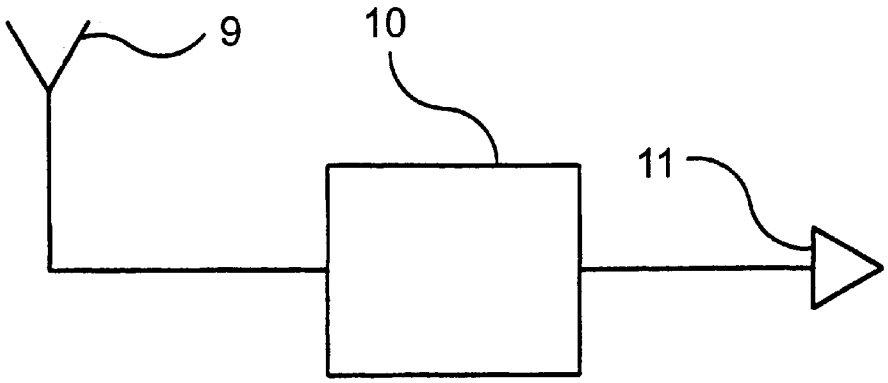
FIG. 2*a* shows a block diagram of a second part of a first preferred embodiment of the invention indicating the first part and including an impedance matching means, and telephone transceiver circuitry.

With reference to FIG. 2*a*, the radiating means 9 (see also FIG. 1) is coupled via an impedance matching means 10 to tranciever circuits 11 of the telephone. In order for the matching means 10 not to require any switching means, in the said first and second configurations of the radiators, the resultant radiator impedance in the feed portion (conductive fitting) must not differ essentially. The matching means 10 includes capacitive and inductive components which act within the first band mainly capacitively and within the second band mainly inductively. In itself, the matching means 10 is resonant at a frequency between center frequencies of the first and second bands.

Figure 2B:
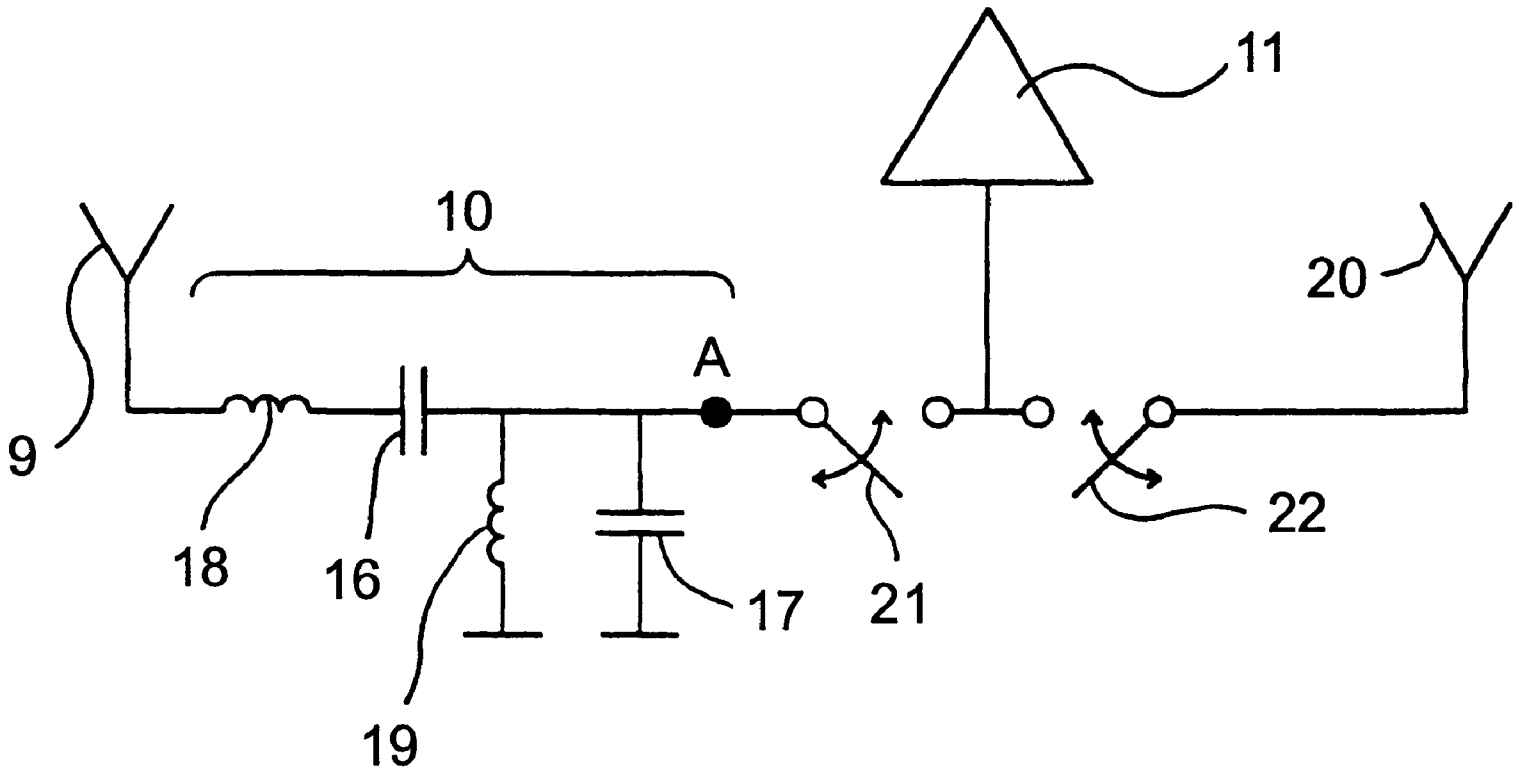
FIG. 2*b* shows a circuit diagram of a second part of a first preferred embodiment of the invention indicating the first part and including an impedance matching means, telephone tranciever circuitry, and means for connecting an external antenna.

With reference to FIG. 2*b* a circuit diagram indicates capacitive components 16, 17 and inductive components 18, 19 constituting the matching means 10. The diagram also indicates how a connection for an auxiliary antenna 20 is realized through switches 21, 22. In case no such connection is included, the telephone circuitry 11 is to be connected to point A in the diagram and the components 21, 22 to the right thereof are to be omitted.

Figure 3A:
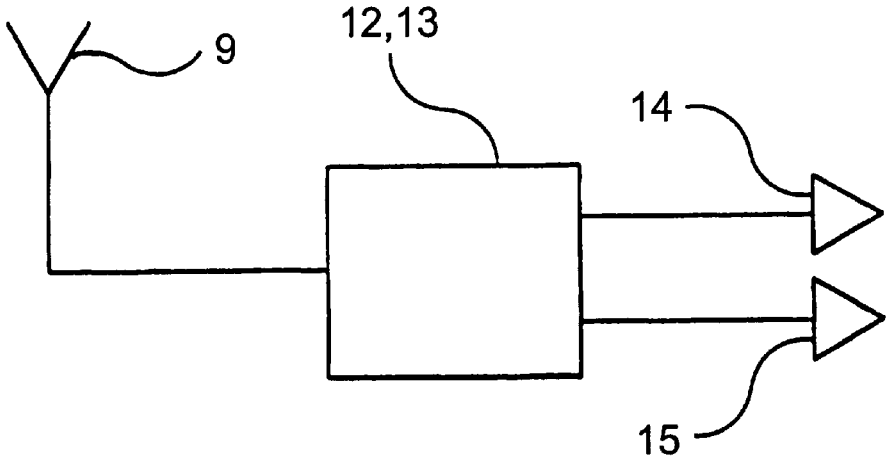
FIG. 3*a* shows a block diagram of a second part of a second preferred embodiment of the invention indicating the first part and including separate impedance matching means, and separate telephone tranciever circuitry.

With reference to FIG. 3*a*, the radiating means 9 (see also FIG. 1) is coupled via separated first and second impedance matching means 12, 13 to separated first and second tranciever circuits 14, 15, for 1800 and 900 MHz, respectively. In order for the matching means 12, 13 not to require any switching means, in the said first and second configurations of the radiators, the resultant radiator impedance in the feed portion (conductive fitting) must not differ essentially. The matching means 12 includes capacitor and inductor components which act as a high-pass filter and act within the first band to match impedances of the radiators and the circuits 14. The matching means 13 includes capacitive and inductive components which act as a low-pass filter and act and within the second band to match impedances of the radiators and the circuits 15. The high and low-pass filters are essential to obtain an isolation between the two branches of this configuration in order for the circuits 14, 15 not to be damage one another.

Figure 3B:
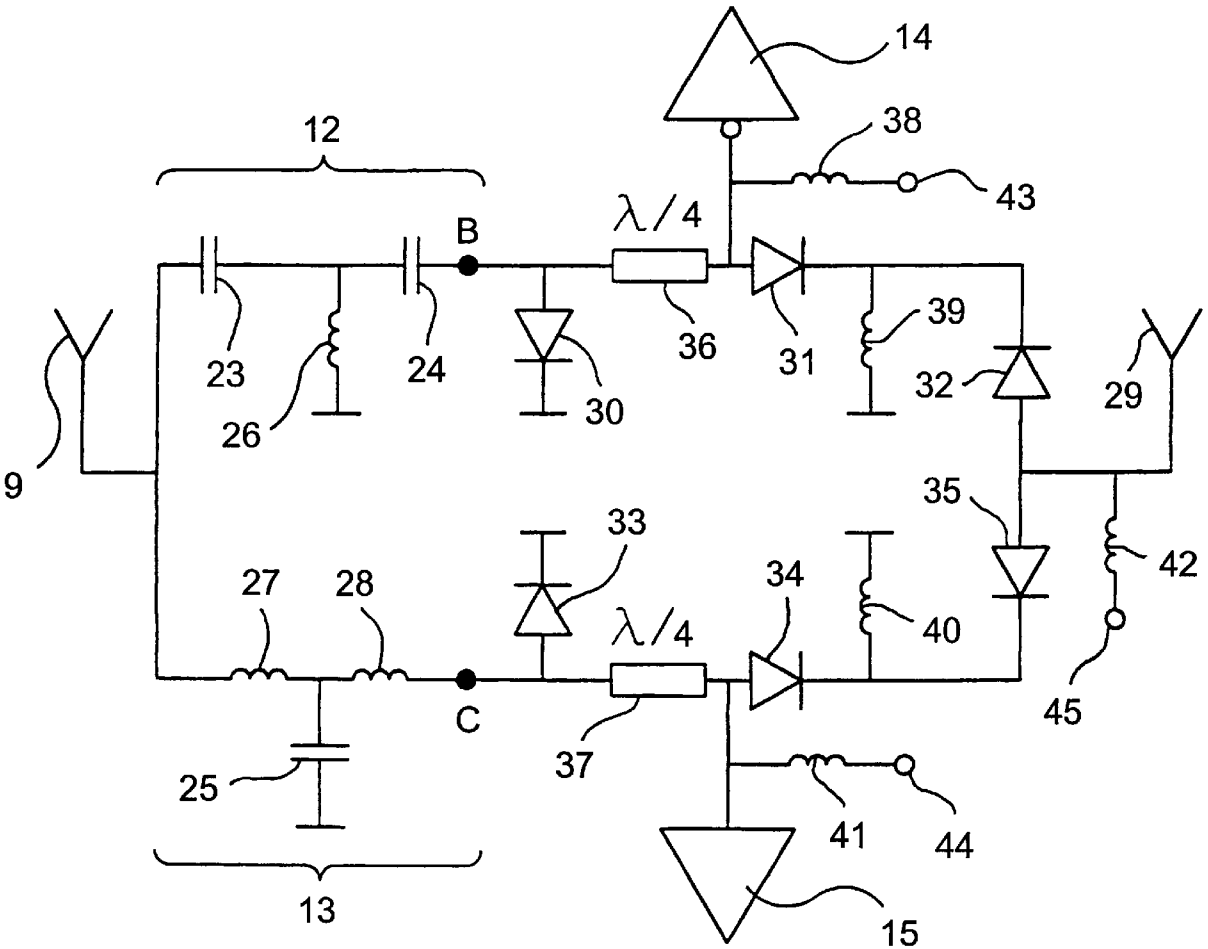
FIG. 3*b* shows a circuit diagram of a second part of a second preferred embodiment of the invention indicating the first part and including an impedance matching means, telephone tranciever circuitry, and means for connecting an external antenna.

With reference to FIG. 3*b* a circuit diagram indicates capacitive components 23, 24, 25 and inductive components 26, 27, 28 constituting the matching means 12, 13. The diagram also indicates how a connection for an auxiliary antenna 29 is realized by a network including PIN diodes 30, 31, 32, 33, 34, 35, quarterwave transformers 36, 37, inductive elements 38, 39, 40, 41, 42, and bias points 43, 44, 45. In case no such connection is included, the telephone circuitry 12 and 13 is to be connected to the points B and C, respectively, in the diagram and the components to the right thereof are to be omitted.

Other possible embodiments of this invention include arranging one or more top helical elements in an upper end of the antenna whip. One such element may be selected to render a combination of the straight radiator and the top helical element resonant within the two frequency bands, or two such elements may be selected to be galvanically isolated from the straight radiator and work in a way similar to the helices of FIG. 1, but make contact with the fitting only in the retracted position.

Although the invention is described by means of the above examples, naturally, many variations are possible within the scope of the invention.

What is claimed is:

1. An antenna means for transmitting and receiving RF signals within each of first and second frequency bands that are widely separated, comprising:

at least one feed portion to be coupled to circuitry of a radio communication device having a housing, an elongated radiating first structure having a first axis of symmetry, said first structure being extendable and retractable, a radiating second structure having a second axis of symmetry and including a helical first element and a helical second element, said first element having a fixed and essentially concentric geometrical relation to said second element, said first element having a smaller diameter than said second element and being arranged to overlap with said second element, said first and second axes of symmetry essentially coinciding, said first element having a resonance frequency different from a resonance frequency of said second element, said second structure, when said first structure is in a retracted position, being operable to transmit and receive RF-signals within each of said first and second widely separated frequency bands, said first structure, when in an extended position, being coupled to said feed portion and being operable to transmit and receive RF-signals within each of said first and second widely separated frequency bands.

2. The antenna means according to claim 1, wherein said first and second elements have essentially equal axial lengths.

3. The antenna means according to claim 1, wherein said first and second elements have first and second upper free ends, respectively, which oppose each other diametrically.

4. The antenna means according to claim 1, wherein said first and second elements have a first and second winding pitches, respectively, said first pitch being greater than said second pitch.

5. The antenna means according to claim 1, wherein said first and second elements are conductively connected at said at least one feed portion.

6. The antenna means according to claim 1, wherein said first structure comprises an essentially straight radiator.

7. The antenna means according to claim 1, wherein said antenna means further comprises:

an impedance matching means connected between said feed portion and said circuitry, said impedance matching means, when said first structure is retracted and is preferably essentially decoupled from said feed portion, matching said second structure to said circuitry, said impedance matching means, when said first structure is extended, matching said first structure to said circuitry.

8. The antenna means according to claim 1, wherein said second structure is coupled to said feed portion and is mounted on said housing.

9. The antenna means according to claim 7, wherein said impedance matching means, when said first structure is extended, matches an inter-coupled combination of said first and second structures to said circuitry.

10. The antenna means according to claim 7, wherein said matching means has one common part for matching, within said first frequency band and said second frequency band, said radiating structures to said circuitry.

11. The antenna means according to claim 10, wherein a configuration of said matching means is selected so as to match, within said first and second frequency bands, said radiating structures to said circuitry in the following cases:

said first structure being extended, said first and second structure being coupled in parallel at lower ends thereof, said first structure being retracted, said first and second structure being essentially decoupled.

12. The antenna means according to claim 7, wherein said circuitry has separated first and second parts, said matching means has a first part for matching within said first frequency band said radiating structures to a first part of said circuitry, said matching means has a second part for matching within said second frequency band said radiating structures to a second part of said circuitry.

13. The antenna means according to claim 12, wherein a configuration of said matching means is selected so as to match, within said first and second frequency bands, said radiating structures to said circuitry, maintaining high isolation between said first and second parts of said circuitry, in the following cases:

said first structure being extended, said first and second structure being coupled in parallel at lower ends thereof, said first structure being retracted, said first and second structure being essentially decoupled.

14. The antenna means according to claim 1, wherein said first structure includes a helically configured portion which enables the first structure to independently resonate within said first frequency band and within said second frequency band.

15. The antenna means according to claim 9, wherein said inter-coupled combination is a series coupling of said first and second structures.

16. The antenna means according to claim 9, wherein said inter-coupled combination is a parallel coupling of said first and second structures.

17. The antenna means according to claim 7, wherein said matching means having the same coupling configuration in said extended and retracted positions of said first structure.

18. The antenna means according to claim 7, wherein said antenna means further comprises a connection for an external antenna via a coupling located between said matching means and a respective circuitry and having a predetermined impedance.

19. The antenna means according to claim 12, wherein said antenna means further comprises:

a connection at a predetermined impedance, preferably 50 ohm, for an external antenna via a circuit including a double change-over switch and first and second quarterwave transformers at said second and first frequency bands, respectively, said switch providing connection alternatively for said external antenna, via said first transformer to said first part of said circuitry and for said second part to signal ground, or for said external antenna via said second transformer to said second part of said circuitry and for said first part to signal ground.

20. The antenna means according to claim 1, wherein reception and transmission of RF signals according to a first telecommunication standard are to be performed within said first frequency band, reception and transmission of radio signals according to a second telecommunication standard, other than said first telecommunication standard, are to be performed within said second frequency band.

21. The antenna means according to claim 1, wherein said antenna means further comprises at least one further radiating element enabling the antenna means to operate within more than two frequency bands.

22. The antenna means of claim 1, wherein said first and second elements are arranged in a way that enables said second structure to resonate at different frequencies, where a first center frequency of said first frequency band and a second center frequency of said second frequency band may have arbitrary separation.

23. The antenna means of claim 1, wherein said first and second elements are arranged in a way that enables said second structure to resonate at different frequencies, where a first center frequency of said first frequency band and a second center frequency of said second frequency band have a ratio of approximately 1:2.

24. The antenna means of claim 1, wherein said first and second elements have a first and second winding pitch, respectively, said first winding pitch being different than said second winding pitch.

25. The antenna means of claim 1, wherein said first and second elements having a first and second winding pitch, respectively, said first winding pitch being greater than said second winding pitch.

* * * * *